United States Patent [19]

Ikeda

[11] 4,116,252

[45] Sep. 26, 1978

[54] METHOD AND APPARATUS FOR PRODUCING BASEBALL BATS

[76] Inventor: Yosaku Ikeda, 7229 Fukumitsu-cho, Nishitonami-Gun, Toyama-ken, Japan

[21] Appl. No.: 838,847

[22] Filed: Oct. 3, 1977

Related U.S. Application Data

[63] Continuation-in-part of Ser. No. 655,424, Feb. 5, 1976, abandoned.

[30] Foreign Application Priority Data

Oct. 13, 1975 [JP] Japan ..... 50-139155

[51] Int. Cl.[2] ..... B29C 15/00; B29G 7/00

[52] U.S. Cl. ..... 144/309 D; 144/309 Y; 144/327; 264/134; 264/294; 264/310; 427/370; 427/382; 427/393; 427/440

[58] Field of Search ..... 264/134, 137, 310, 296, 264/294; 144/309 D, 309 H, 327, 309 Y; 273/72 R, 82 R; 427/369, 370, 393, 440, 382; 428/529

[56] References Cited

U.S. PATENT DOCUMENTS

| | | | |
|---|---|---|---|
| 838,391 | 12/1906 | Dittmar | 144/309 D |
| 2,298,017 | 10/1942 | Loughborough | 144/309 D |
| 2,300,760 | 11/1942 | Amigo | 264/296 X |
| 2,412,523 | 12/1946 | Lundstrom | 144/327 X |
| 2,793,859 | 5/1957 | Darling | 144/309 H |
| 3,024,819 | 3/1962 | Dosker | 144/327 X |
| 3,562,376 | 2/1971 | Hameister | 264/294 X |

*Primary Examiner*—W.E. Hoag

*Attorney, Agent, or Firm*—Ostrolenk, Faber, Gerb & Soffen

[57] ABSTRACT

A method and apparatus for producing baseball bats which have high surface hardness and are hardly broken, and said method comprises the steps of: forming a baseball bat having a diameter somewhat larger than the prescribed dimension; impregnating thermosetting resin into said baseball bat; and treating said impregnated bat with heat and pressure by using a set of molds consisting of three or more of divided mold sections.

2 Claims, 1 Drawing Figure

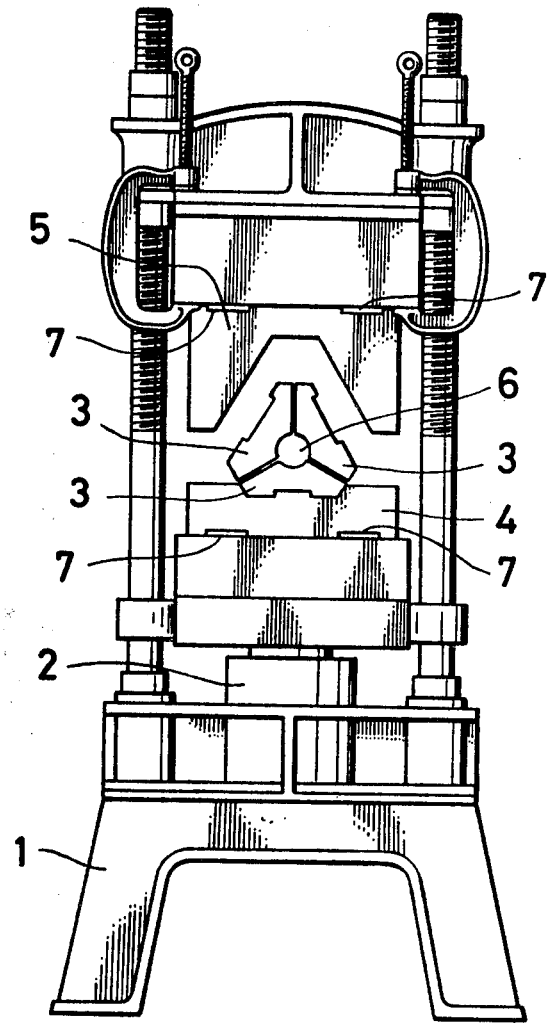
5
7
7
6
3
3
3
4
7
7
2
1

METHOD AND APPARATUS FOR PRODUCING BASEBALL BATS

This is a continuation-in-part of application Ser. No. 655,424, filed Feb. 5, 1976 (now abandoned).

BACKGROUND OF THE INVENTION

This invention relates to a method for producing improved baseball bats. More particularly, the invention relates to improvement in baseball bat manufacturing by which baseball bats having respective hardened hitting zones and which are difficult to break are produced.

In baseball bat manufacturing, hard wood is generally selected since a ball may be driven a greater distance with a bat having a harder surface. In view of this fact, aluminum bats have been also produced and sold in recent years. The process for producing aluminum bats is, however, totally unified, so that a large variety of aluminum bats are difficult to produce. In this regard, since wooden bats are produced by cutting wooden material, a bat complying with any person's wishes can be advantageously produced. However, wooden bats have other drawbacks that they are liable to split along the grain and to break across the grain when they receive excessive force. As the method for eliminating these disadvantages of wooden bats, there is well known a method to impregnate thermosetting resin into wood and to treat with heat and pressure as disclosed in Japanese Patent Publication Nos. 4961 of 1963 and 1279 of 1958.

In this process, there are two purposes of compression, one is to break up the wood surface structure and other is to improve the density of wood. When the wood surface structure is broken down, the wood grain mingles with the remaining wood portions and when the wood in this condition it is solidified with resin, the wood grain becomes difficult to peel off. The resin fills up the void spaces of grain to increase the density and as a result the hardness of wood is increased. Thus a bat which hits a ball to a distance and is rarely broken may be produced.

In the conventional art, this object has been attained by compressing wood material in the direction of wood grain layers using a pair of mold halves. By this method, the material receives the force in the direction of working of the molds, however, the force in the direction at a right angle to the mold working direction cannot be sufficiently effected. Therefore uneven compression of the material is caused to occur. Another disadvantage of the molds of this type is that the bat is slightly swollen in the direction perpendicular to the compressing direction because the bat is squeezed by a pair of molds, and the wood material swells out through the gaps of the molds which reduces the commercial value of the products.

BRIEF SUMMARY OF THE INVENTION

In order to avoid and eliminate the above-mentioned disadvantages, the inventor has carried out extensive studies on the production of wooden baseball bats and as a result, the present invention has been accomplished.

Therefore the primary object of the present invention is to provide an improved method for producing baseball bats having sufficient strength and surface hardness.

Another object of the present invention is to provide an improved method for producing baseball bats which are impregnated with resin and compressed evenly from all directions.

A further object of the present invention is to provide an improved method for producing baseball bats, which method is advantageously adopted in the manufacture of wooden baseball bats.

Still a further object of the present invention is to provide an improved molding apparatus for carrying out the above method without any trouble and difficulty.

In accordance with the present invention, the method for producing baseball bats comprises the steps of: forming a wooden baseball bat having an initial diameter somewhat larger than the prescribed dimension; impregnating thermosetting resin into said baseball bat, and treating the impregnated bat with heat and pressure in a molding apparatus having at least three divided mold sections.

The molding apparatus for producing baseball bats of the present invention comprises at least three separable mold sections, a supporting block for supporting the mold sections, an additional upper positioning block for the mold sections, and means for driving the supporting block toward the positioning block, the above mold sections together defining a central opening for receiving the pre-impregnated bat. Further, all the pressures of the mold sections are effected toward the center of the circular cross-section of the bat and the outer surface of the bat receives even force. Thus the portion of bat forced out into the gaps of molds can be reduced to a large extent as compared with the case of a pair of molds being used. When the mold is divided into too many sections, it becomes difficult to exert pressure uniformly on each mold sections, so that the number of divided molds is preferably from three to six in general operation.

As the thermosetting resins used for the impregnation of bats, melamine resin, phenol resin, urea resin, polyester resin, epoxy resin and polyurethane resin are exemplified. The effective temperatures for impregnation and compression are different with the kinds of resins, though they may be about 100° C.

In the compression step, it is desirable to increase the pressure step by step, for example, starting with normal pressure heating, then 20 - 30 kg/cm$^2$, next 100 - 150 kg/cm$^2$, and lastly 150 - 200 kg/cm$^2$. Further it is important that the gaps of molds are directed toward the center of the bat to be treated and the bat is rotated during the treatment with pressure.

BRIEF DESCRIPTION OF THE DRAWING

These and other objects and features of the invention will become more apparent from the following description taken in connection with the accompanying drawing in which:

The FIGURE is a front elevation of the molding apparatus for treating a pre-impregnated bat with heat and pressure according to the present invention.

DETAILED DESCRIPTION OF THE INVENTION

The method and apparatus of the present invention will be disclosed in more detal referring to the accompanying drawing. The mold of the apparatus exemplified in the drawing is divided into three mold sections. However, the apparatus having more than 3 mold sections may also be used by those skilled in the field of this invention.

In the method of the present invention, a baseball bat having a diameter, for example, about 2 mm larger than the inner diameter of the set of mold sections in the clamped state is formed. The solution of the above-mentioned resin is then applied to the bat by immersion. When pressurized, the impregnation of the resin into wood can be accelerated. After the above impregnation of resin for 1 to 2 days, the bat is taken out from the resin solution and is subjected to the primary curing for 2 to 3 days.

Then the bat is treated with heat and pressure by the apparatus as shown in the drawing. The machine bed 1 is provided with a lifting device 2 such as a jack, and a supporting block 4. An upper support or a positioning block 5 for receiving the mold sections 3 is attached above the support block 4. In the drawing, the numeral 6 indicates an opening for inserting a bat to be treated. In order to heat the mold sections 3 during the thermal compression step, electric heaters are inserted into the spaces 7.

The aforementioned bat (not shown) being impregnated with resin is inserted into the opening 6 of the mold sections 3 and the lifting device 2 is moved up by, for example, hydraulic pressure or air pressure. The supporting block 4 on the lifting device 2 is thereby raised. Through this operation, the mold sections 3 are squeezed between the supporting block 4 and the upper support 5, and the bat placed in the opening 6 is thereby compressed. The bat having somewhat larger diameter is reduced in its diameter to a desired dimension and at the same time the resin applied on the surface portion of the bat is caused to penetrate into the wood and finally cured. In this compression step, the pressure is increased step by step and the bat may be preferably rotated on its axis.

EXAMPLE 1

A wooden bat having a diameter about 2 mm larger than the inner diameter of closed mold sections, is formed. The bat is then dried to less than 10% in water content. A 50% methanol solution of phenol resin is prepared and the bat is immersed in the solution for 1 to 2 days. (This impregnation can be accelerated by applying pressure).

The bat is taken out from the resin solution and is subjected to primary curing for 2 to 3 days.

The bat is then fitted to the above-mentioned pressing apparatus and 20 to 30 kg/cm$^2$ of pressure is applied to the bat at a temperature of about 100° to 120° C. Then the bat is rotated about 60° and 100 to 150 kg/cm$^2$ of pressure is applied. In the treatment at this pressure, the rotations of the bat are repeated for 3 to 5 times. After this step, the pressure is increased to 150 to 200 kg/cm$^2$ and kept as it stands for about 1 hour.

It has been understood that the bat produced by the above process has a very high surface hardness and is not easily broken.

EXAMPLE 2

By using urethane resin, a bat was produced in like manner as the above Example 1 and a similar result was obtained.

Although the present invention has been described in connection with a preferred embodiment thereof, many variations and modifications will now become apparent to those skilled in the art. It is to be noted, therefore, that the present invention be limited not by the specific disclosure herein, but only by the appended claims.

What is claimed is:

1. A method of producing baseball bats which comprises the steps of: forming a wood baseball bat having an initial diameter somewhat larger than the prescribed dimension; impregnating thermosetting resin into said baseball bat sufficiently to effect hardening to withstand heavy impact in the finished product; treating said impregnated bat with heat at about 100° to 120° C and pressure in a mold comprising at least three divided mold sections, said method including intermittent partial rotation in said mold with increased pressure; and thereafter maintaining said bat in said mold at a further increased pressure for a predetermined period.

2. A method as set forth in claim 1, wherein said partial rotation is about 60° occurring three to five times; said increased pressure is about 100 to 150 kg/cm$^2$ and said further increased pressure is about 150 to 200 kg/cm$^2$.

* * * * *